US005363080A

United States Patent [19]

Breen

[11] Patent Number: 5,363,080

[45] Date of Patent: Nov. 8, 1994

[54] HIGH ACCURACY SURFACE MOUNT INDUCTOR

[75] Inventor: Barry N. Breen, Givat Ze'ev, Israel

[73] Assignee: AVX Corporation, New York, N.Y.

[21] Appl. No.: 813,789

[22] Filed: Dec. 27, 1991

[51] Int. Cl.[5] ..... H01F 15/10; H01F 27/30

[52] U.S. Cl. ..... 336/192; 336/200; 336/232

[58] Field of Search ..... 336/220, 232, 225, 192, 336/180

[56] References Cited

U.S. PATENT DOCUMENTS

| | | | |
|---|---|---|---|
| 3,798,059 | 3/1974 | Astle et al. | 336/200 |
| 3,848,210 | 11/1974 | Felkner | 336/232 |
| 4,310,821 | 1/1982 | Frances . | |
| 4,313,152 | 1/1982 | Vranken . | |
| 4,322,698 | 3/1982 | Takahashi et al. | 336/200 |
| 4,494,100 | 1/1985 | Stengel et al. | 336/200 |
| 4,545,553 | 9/1985 | Mandai et al. | 336/232 |
| 4,613,843 | 9/1986 | Esper et al. | 336/232 |
| 4,626,816 | 2/1986 | Blumkin et al. . | |
| 4,641,114 | 2/1987 | Person . | |
| 4,689,594 | 8/1987 | Kawabata et al. | 336/200 |
| 4,803,543 | 2/1989 | Inayoshi et al. . | |
| 4,926,292 | 5/1990 | Maple . | |
| 4,959,631 | 9/1990 | Hasegawa et al. | 336/232 |
| 5,051,712 | 9/1991 | Naito et al. | 336/200 |
| 5,071,509 | 12/1991 | Kano et al. . | |

FOREIGN PATENT DOCUMENTS

| | | | |
|---|---|---|---|
| 58-67007 | 4/1983 | Japan | 336/200 |
| 59-58806 | 4/1984 | Japan | 336/200 |
| 59-114807 | 7/1984 | Japan | 336/200 |
| 62-189707 | 8/1987 | Japan | 336/200 |
| 2-128409 | 5/1990 | Japan | 336/200 |

*Primary Examiner*—Thomas J. Kozma
*Attorney, Agent, or Firm*—Spensley Horn Jubas & Lubitz

[57] ABSTRACT

A high accuracy surface mount inductor device is comprised of first and second parallel planar spiral conductive patterns mounted over a rectangular substrate. The outermost conductive traces of the respective patterns extend to opposite edges of the device and are contacted by terminations extending over the ends of the device. The terminations are U-shaped and include legs extending over parts of the upper and lower surfaces adjacent the ends. The legs overlie the outermost traces and preferably terminate at a position coincident with or not extending inwardly beyond the innermost portions of the outermost traces.

7 Claims, 3 Drawing Sheets

HIGH ACCURACY SURFACE MOUNT INDUCTOR

BACKGROUND OF THE INVENTION

The present invention is in the field of inductive devices and relates more particularly to a chip type inductive device characterized in its being surface mountable, of small size and low profile, high power handling capacity and, most especially, readily adapted to be designed to extremely tight tolerances.

Devices of this sort are employed in connection with cellular phones, personal communication networks, cable TV, global positioning systems, vehicle location systems, all types of high frequency filters and all similar high frequency equipment, to frequencies of 2400 MHz.

Prior Art

Conventional miniaturized inductors have heretofore been of two general types, namely wire wrapped chips and monolithic ferrite chips. The wire wrapped chips exhibit poor mechanical properties, are generally far larger than desirable, and are poorly designed for use in surface mounting applications. More particularly, in current circuit applications it is highly desirable for a component to be of low profile, and the wire wound chips are, in all instances, high profile devices.

A second type of inductor is formed of a monolith of ferrite. Chips of this sort exhibit poor high frequency performance.

It has been proposed in various prior art references to provide a miniature inductor suitable for high tolerance applications. By way of example, reference is made to U.S. Pat. No. 4,310,821, which discloses a printed inductance device formed on a foldable substrate.

U.S. Pat. No. 4,313,152 is directed to a miniaturized electrical coil comprised of a plurality of spiral coils with multiple connectors between the coils, the coils being configured to minimize capacitance.

U.S. Pat. No. 4,543,553 relates to a chip type inductor comprised of a multiplicity of magnetic layers, each layer having only a portion of an inductive pattern, the layers being interconnected to form a continuous coil. Terminations may be formed on the end faces to render the chip suitable for surface mounting.

U.S. Pat. No. 4,613,843 discloses a transducer for an automobile and including a coil on a ceramic substrate which is located adjacent a moving magnet for use in sensing various crankshaft positions. The coil of this device is comprised of one or more superposed flat layers which are spirally wound and which are formed by metal deposition techniques.

U.S. Pat. No. 4,626,816 discloses a flat coil assembly comprised of a series of spiral conductive coils on a insulative slab having jumpers connecting the inner ends of the coils, the outer ends of the coils being connected to pads on the slab.

U.S. Pat. No. 4,641,114 is directed to a delay line comprised of a multiplicity of circuits stacked one atop the other. Each delay circuit is formed of a solid sheet of conductive material etched to a spiral configuration, the ends of successive layers being connectable in series via separate contact pads.

U.S. Pat. No. 4,803,543 is directed to a laminated transformer comprised of a plurality of ferrite sheets on which conductive patterns are formed and which are sintered to define the transformer. Each layer includes a partial coil which is connected to the adjacent layer to define a completed circuit.

U.S. Pat. No. 4,926,292 is directed to a thin film printed circuit inductive device comprised of a conductive spiral having resistive links connected between adjacent turns to minimize inherent resonances.

SUMMARY OF THE INVENTION

The present invention may be summarized as directed to an improved high precision surface mountable inductor characterized in that the geometry of the device and its terminations is so configured as to permit extremely tight tolerances to be retained.

More particularly, in high frequency applications, it is imperative for highest efficiency and accuracy that the inductive components be retained within extremely tight tolerance ranges, i.e. in the magnitude of $\pm 2$ or $\pm 5$ percent. The difficulties in retaining such tolerances where inductances are as low as 3.9 nH will be readily apparent.

It has been discovered that a deficiency in flat inductors, which has greatly interfered with the ability to accurately design and repeatedly reproduce the same within precise tolerance ranges, resides in the failure of the prior art devices of this sort to recognize the appreciable effect of lead configuration on the inductance of the finished device.

More particularly, in known devices of the printed or metal deposited type, one or more of the lead conductors and/or the links which electrically couple coil components from layer to layer, have traversed the coil configurations defining the inductance. Thus, despite the accuracy with which the coils themselves may be configured, the lead contributes to the inductance in such manner as to unpredictably vary the actual inductance value of the device.

A salient feature of the instant invention resides in the provision of a surface mountable flat inductor device, the geometry of which is such that terminations are effected without any material variation of the inductance value of the device. In this manner, since the inductance value is solely a function of the location of the conductors of the multiple coils defining the device, and the spacing of such coils, the design and fabrication of an inductor to a precise value may be readily achieved by standard computations without trial and error and without introducing into the equation unpredictable inductance variations dictated by lead paths between the inductive coils and the terminations.

Still more particularly, the invention is directed to a surface mountable, high precision planar inductor comprised of two coil patterns which are superposed in spaced relation. A first coil pattern is comprised of a spiral (the term spiral is used herein to connote a path having straight as well as curved sides), an outermost end of which coincides with an end edge of a rectangular substrate, and the innermost terminus of which is located generally centrally of the substrate. The first planar coil is covered by an insulative layer on which a second planar coil is formed. The second planar spiral coil includes an outer edge portion coincident with an opposite edge of the substrate from the exposed edge of the first coil. The second spiral coil has its inner terminus located in registry with the inner terminus of the first coil, the termini of the respective coils being connected by a conductor formed in a via hole through the insulative layer covering the lowermost coil.

Termination is effected by coating with conductive metal the edge portions of the substrate at which the outermost edges of the two coils are exposed, the metallic coating in addition covering limited portions of the upper and lower surfaces of the substrate, whereby the device may be surface mounted by connections to the components of the terminations on either of major faces of the substrate. Preferably the coatings forming the termination portions on the major faces are in registry with and do not extend inwardly beyond the outermost conductive portions of the respective coils to minimize the effect of the terminations on the inductance of the device.

As will be apparent from the preceding general description, there are essentially no components in the conductive path which are not themselves comprised of elements of the inductor. By eliminating lead extending between the operative elements of the coil and the terminations, and by minimizing inductance variations created by the terminations themselves there is likewise eliminated the elements which induce variations into the inductive circuit with consequent loss of precision and predictability.

It is accordingly an object of the invention to provide a high precision, compact, surface mountable inductor.

A further object of the invention is the provision of a surface mountable inductor of the type described wherein the pattern configuration necessary to achieve a desired inductance may be readily and precisely calculated without trial and error since the geometry of the inductor permits the inductance value to be solely a function of the dimensions and spacing of the conductive components forming the inductance itself, i.e. free from extraneous inductances resulting from lead paths and termination interaction as found in prior art inductive devices.

FIGS. *2a* through *2m* are schematic sectional views illustrating the progressive stages of manufacture of the inductor device.

DETAILED DESCRIPTION OF DRAWINGS

Figure 1:
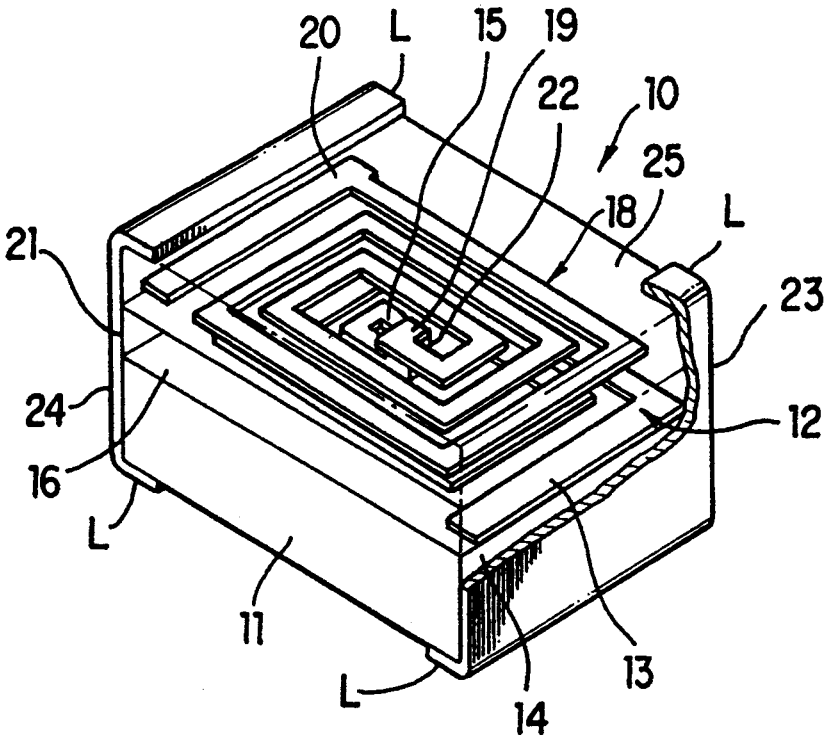
FIG. 1 is a perspective view of a surface mountable inductor chip in accordance with the invention with parts broken away to show details of construction.

Referring specifically to FIG. 1, there is shown in perspective view a completed inductor device 10 in accordance with the invention.

The inductor device 10 includes a substrate 11 of the alumina or like rigid insulative material, the substrate being rectangular in plan. A first conductive spiral pattern 12 is formed over the alumina substrate, the pattern 12 being in the configuration of a spiral having square sides. A leg 13 of the spiral pattern 12 has its outermost edge coincident with the side edge 14 of substrate 11. The spiral pattern 12 ends at an inner terminus 15 disposed generally centrally of the substrate 11.

A polymeric or other low dielectric constant insulator layer 16 is formed over pattern 12, the insulative layer 16 being formed with a via aperture 17 in registry with the terminus 15 of spiral pattern 12.

A second conductive pattern 18 of spiral configuration is formed on the upper surface of insulator 16, spiral pattern 18 including an innermost terminus 19 disposed adjacent the via 17 in layer 16. The pattern 18 which is likewise in the configuration of a squared-off spiral includes an outermost leg 20 whose outer edge coincides with the outer surface 21 of the substrate 11 and insulator 16. The via 17 is filled with a conductive metallic component 22 which links terminus 15 of pattern 12 with the terminus 19 of pattern 18, whereby the spiral patterns are connected at their centers.

Terminations 23,24 are formed over the ends 14 and 21 respectively, the termination 23 being in electrical contact with leg 13 of pattern 12, and the termination 24 being in contact leg 20 of pattern 18. The terminations 23,24 are preferably of U-shaped configuration covering the entire ends of the inductor member 10, the terminations including leg portions L which overlap the upper and lower surfaces of the inductor 10. A upper insulative layer 25 is applied over the uppermost pattern 18 in advance of application of the terminations 23,24. Preferably, the leg portions L do not extend inwardly along the respective major faces of the inductor 10 a distance beyond the innermost edges of legs 13 and 20 of patterns 12 and 18 respectively.

As will be apparent from the preceding description the inductor may aptly be described as a "leadless" inductor, since there are no components or elements interposed between the terminations and the patterns defining the inductor. In other words, it is the outermost component of the two spiral patterns which themselves function to connect the patterns to the respective terminations. The structure, thus, is in contrast to known inductors wherein the terminations are separated from inductive patterns and it is necessary to link the terminations to the patterns by a lead or leads which themselves necessarily contribute in an unpredictable manner to the inductive value and performance of the device. With the configuration of the instant inductor, the value of the inductance is a function essentially exclusively of the configurations of the patterns 12 and 18 and the spacing of the respective patterns. Also, a low resistance connection between pattern and termination is assured, since the terminations engage the entire length of the outermost legs of the coils.

It is accordingly possible by mathematical calculation readily to design and fabricate an inductance of a desired value within precise tolerances and without the trial and error procedures which inhere in inductive devices wherein leads extend between the terminations and the inductive paths.

METHOD OF MANUFACTURING

There will next be described, by way of compliance with "best mode" requirements of the patent laws, a description of the preferred method of manufacturing the inductor of the invention. With reference to FIGS. *2a* through *2m* there is schematically disclosed in such figures the sequence of manufacturing steps employed in the fabrication of the inductor.

Figure 2A:
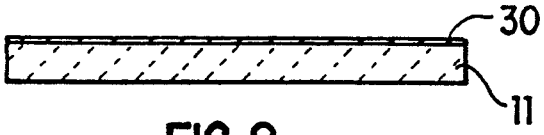
Figure 2B:
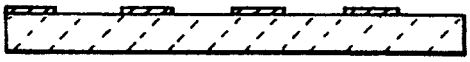
Figure 2C:
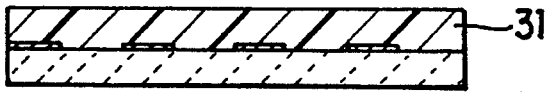
Figure 2D:
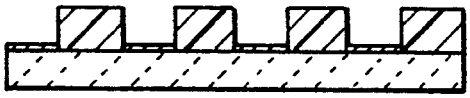

Referring to FIG. *2a* the substrate 11 of alumina is sputter coated over its entire upper surface with a thin metal layer 30, e.g. of chromium or titanium tungsten alloy and optionally a covering layer, illustratively of aluminum, copper, gold or silver. The metal layer 30 is etched by conventional photolithographic methods to the configuration of the pattern 12 (FIG. *2b*), thereafter a first photosensitive polyimide layer 31 is applied over the surface of the substrate and etched metal to a thickness 30 $\mu$. The application and processing of polyimide is a known technique and it is described in detail in an article entitled "Recent Advances in Photoimagable Polyimides", appearing in SPIE, Volume 639 (1985), at pages 175 and following. The polyimide is masked and exposed to UV light and rinsed to define channels in registry with the pattern of metal as shown in FIG. 2*d*.

Figure 2E:
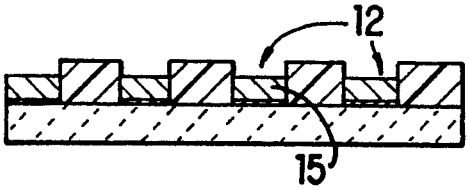

As shown in FIG. 2*e* the exposed metal is electroplated to a depth of 28 μ with a metal such as copper, silver, gold or aluminum to form the lower spiral pattern 12 (FIG. 2*e*) .

Figure 2F:
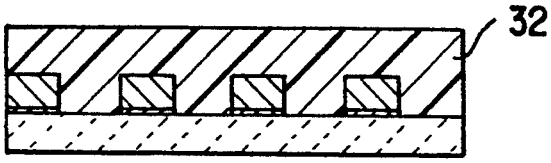
Figure 2G:
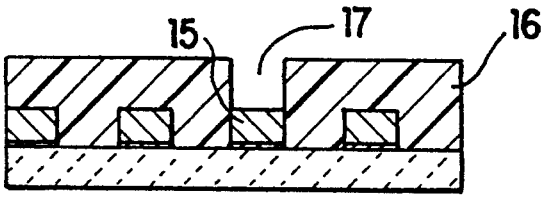

As shown in FIG. 2*f* a further (50 μ thick) polyimide layer 32 is deposited over the product of FIG. 2*e*, masked, exposed and developed to form a via 17 in registry with the terminus 15 of pattern 12 (FIG. 2*g*).

Figure 2H:
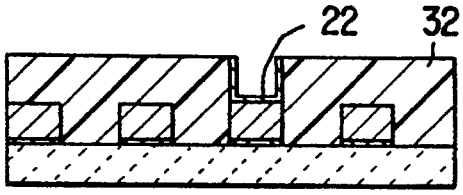
Figure 2I:
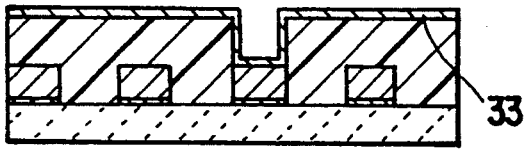
Figure 2J:
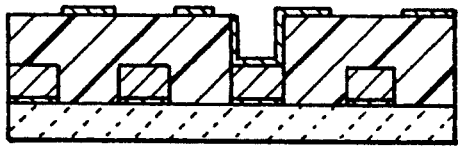
Figure 2K:
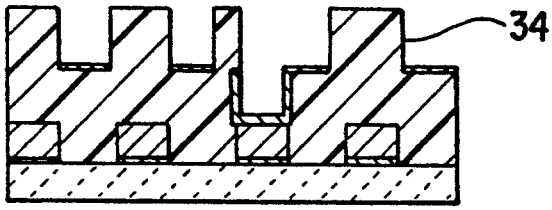
Figure 2L:
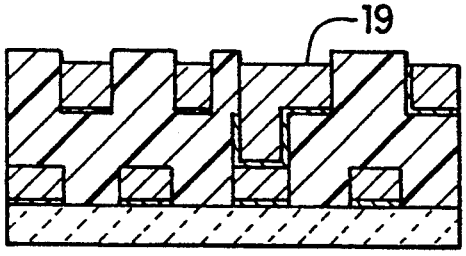

As shown in FIG. 2*h* the via 17 is electroplated to form the layer connection 22 (FIG. 2*h*). Thereafter the surface of layer 32 is sputtered to form a metal coating 33 (FIG. 2*i*) and etched to define a conductive pattern in the configuration in the upper spiral pattern 18 (FIG. 2*j*). Thereafter a further polyimide layer 34 is deposited over the etched layer 33, masked and developed to provide channels (30 μ deep) in registry with the etched components of FIG. 2*j* leaving the configuration of FIG. 2*k*. Thereafter the channels in polyimide layer 34 are electroplated to a depth of 28 μ to form the upper spiral pattern 18, it being noted that the inner terminus 19 of the upper pattern is in registry with the fill metal 22 in via 17.

The partially completed inductor of FIG. 21 is thereafter overcoated with an upper layer 35, e.g. of thermal polyimide and terminations 23,24 of U-shaped configuration are formed over the edges of the inductor. The terminations are desirably formed by first masking, sputtering, thereafter applying a nickel plate and thereafter a solder coat. The legs L of the terminations L, preferably do not extend inwardly over the upper and lower surfaces of the device beyond the innermost extremities of the outermost coil traces.

Figure 2M:
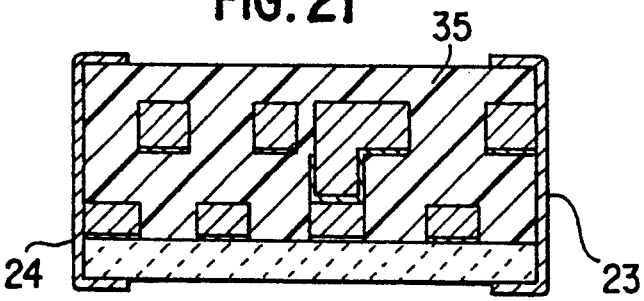

It will be understood that while the drawings FIGS. 2*a* through 2*m* disclose a single inductor being formed, it will be recognized that steps of FIGS. 2*a* through 21 are effected simultaneously on a multiplicity of repeats formed on a single sheet surface, and the sheet is diced before application of the terminations (FIG. 2*m*).

As will be apparent from the preceding description, the inductor of the instant invention may be made in any of a number of sizes and is suitable for surface mounting atop a PC board having metallic circuit defining traces, including solder pads, by placing the terminations 23,24 in registry with the pads and effecting solder in any of a multiplicity of known soldering techniques. The units may be of a standardized size readily adaptable to "pick and place" which automatically locate the inductors with respect to their intended position on the circuit board. The inductors may be thus contrasted with conventional inductors of the coil type, which are necessarily substantially larger than the inductors of the invention and which are irregular in their external dimension causing non-reliable location on the PC board.

As noted, as a result of the absence of lead paths and termination interference there is provided an inductor which is highly compact and which permits the fabrication of inductors with predictable values without trial and error.

I claim:

1. A high accuracy surface mount inductor comprising in combination:

(1) a flat insulating rectangular substrate having first and second opposed end portions, an upper planar surface and a lower planar surface;

(2) a first, non-magnetic insulating layer covering the upper planar surface, the first insulating layer having a first channel defining a first planar coil pattern having a spiral configuration, an outermost coil portion and an innermost terminus at a generally central location of said substrate;

(3) a first planar, metal coil substantially filling said first channel to a predetermined depth and conforming to the coil pattern defined by said first channel, said first coil including an outermost portion and an innermost terminus;

(4) a second, non-magnetic insulating layer covering said first insulating layer and said first coil, a via aperture being formed through the thickness of said second insulating layer in registry with said innermost terminus of said first coil;

(5) a third, non-magnetic insulating layer covering said second insulating layer and having a second channel defining a second planar coil pattern having a spiral configuration, an outermost coil portion and an innermost terminus in registry with said via aperture;

(6) a second planar, metal coil substantially filling said second channel to a predetermined depth and conforming to the coil pattern defined by the second channel, said second channel including an outermost portion and an innermost terminus in registry with said via aperture;

(7) conductor means in said via aperture connecting the innermost termini of said first and second coils;

(8) a cover layer of non-magnetic, insulating material formed over said third insulating layer and second coil; and (9) first and second terminations covering said first and second end portions, respectively, of said substrate and said insulating layers and electrically connected to said first and second coils at the locations of said outermost coil portions, said terminations including contact portions overlying the cover layer and the lower surface of the substrate.

2. A high accuracy surface mount inductor as defined in claim 1, wherein the first, second and third insulating layers are formed of photoimagable polyimide.

3. A high accuracy surface mount inductor as defined in claim 1, in which the substrate, insulating layers and cover layer have opposed end edges defining opposed, planar end faces, the outermost portion of one of said coils having an end edge in registration with and extending the length of one of said end faces, the outermost portion of the other of said coils having an end edge in registration with and extending the length of the other of said end faces, the first termination means covering one of said end faces and being connected to the end edge of the outermost portion of one of the coils and the second termination means covering the other of said end faces and being connected to the end edge of the outermost portion of the other of said coils.

4. A high accuracy surface mount inductor as defined in claim 1 in which the outermost coil portions and contact portions have inner edges, and in which the inner edges of the contact portions do not extend along the cover layer and lower surface of the substrate a distance beyond the inner edges of the outermost coil portions.

5. A high accuracy surface mount inductor as defined in claim 1 in which the first and second coils are made of a material selected from the group consisting of copper, aluminum, gold or silver.

6. A high accuracy surface mount inductor as defined in claim 5 in which the coils have a height of about 28 microns.

7. A high accuracy surface mount inductor as defined in claim 6 in which the second insulating layer has a thickness of about 50 microns.

* * * * *